US010201974B2

(12) United States Patent
Yamamuro et al.

(10) Patent No.: US 10,201,974 B2
(45) Date of Patent: Feb. 12, 2019

(54) PROCESS FOR PRODUCING LIQUID DISCHARGE HEAD

(71) Applicant: CANON KABUSHIKI KAISHA, Tokyo (JP)

(72) Inventors: Jun Yamamuro, Yokohama (JP); Kazuhiro Asai, Kawasaki (JP); Keiji Matsumoto, Kawasaki (JP); Koji Sasaki, Nagareyama (JP); Masahisa Watanabe, Yokohama (JP); Kunihito Uohashi, Yokohama (JP); Seiichiro Yaginuma, Kawasaki (JP); Ryotaro Murakami, Yokohama (JP); Kenji Fujii, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 204 days.

(21) Appl. No.: 15/044,514

(22) Filed: Feb. 16, 2016

(65) Prior Publication Data

US 2016/0271949 A1 Sep. 22, 2016

(30) Foreign Application Priority Data

Mar. 20, 2015 (JP) ..... 2015-057952

(51) Int. Cl.
*B41J 2/16* (2006.01)

(52) U.S. Cl.
CPC ..... *B41J 2/1603* (2013.01); *B41J 2/1628* (2013.01); *B41J 2/1629* (2013.01); *B41J 2/1631* (2013.01); *B41J 2/1639* (2013.01); *B41J 2/1645* (2013.01)

(58) Field of Classification Search
CPC ..... B41J 2/1603; B41J 2/1628; B41J 2/1629; B41J 2/1631; B41J 2/1639; B41J 2/1645
See application file for complete search history.

(56) References Cited

U.S. PATENT DOCUMENTS

| | | | | |
|---|---|---|---|---|
| 7,523,553 | B2 | 4/2009 | Ohsumi et al. | |
| 7,930,824 | B2 | 4/2011 | Ohsumi et al. | |
| 2011/0063361 | A1 | 3/2011 | Ciampini et al. | |
| 2014/0083974 | A1* | 3/2014 | Matsumoto | B41J 2/1603 216/41 |
| 2015/0004724 | A1* | 1/2015 | Watanabe | B41J 2/1603 438/21 |

FOREIGN PATENT DOCUMENTS

| | | | |
|---|---|---|---|
| JP | 2007-230234 | A | 9/2007 |
| JP | 2014-061652 | A | 4/2014 |
| JP | 2015-009429 | A | 1/2015 |

* cited by examiner

*Primary Examiner* — Robert S Walters, Jr.
(74) *Attorney, Agent, or Firm* — Venable LLP

(57) ABSTRACT

A process for producing a liquid discharge head including a substrate having a liquid supply path passing through from its first surface to second surface and an discharge port forming member having a discharge port communicating with the supply path through a flow path, the process including providing a first layer of photosensitive resin in a region covering an opening of the supply path in the first surface; forming a latent image of a pattern of the flow path in the first layer by exposure; providing a second layer of negative photosensitive resin on the first layer; curing a portion, opposing to the opening of the supply path in the first surface, of the second layer; forming a latent image of a pattern of the discharge port in the second layer by exposure; and developing latent images of patterns of the flow path and discharge port.

11 Claims, 3 Drawing Sheets

PROCESS FOR PRODUCING LIQUID DISCHARGE HEAD

BACKGROUND OF THE INVENTION

Field of the Invention

The present invention relates to a process for producing a liquid discharge head.

Description of the Related Art

An ink jet recording head is mentioned as an example of a liquid discharge head. As a process for producing this liquid discharge head, there is known a process in which a side wall of a flow path is formed on a substrate on which an energy-generating element for discharging a liquid is arranged, a plate member covering the flow path surrounded by the side walls is bonded thereon, and a discharge port is then provided at a predetermined portion of the plate member to form a discharge port forming member.

Japanese Patent Application Laid-Open No. 2007-230234 discloses a process for producing an ink jet recording head, which has the following steps:

a step of forming a side wall of a flow path which will become a part of a flow path forming member on a substrate having an energy-generating element for discharging an ink and a supply port for supplying the ink to the energy-generating element;

a step of bonding a layer which will become a part of the flow path forming member on the side wall of the flow path;

a step of providing a water-repellent layer on a surface of the layer bonded on the side wall of the flow path; and a step of forming a discharge port on the layer on the surface of which the water-repellent layer is provided.

According to the production process disclosed in Japanese Patent Application Laid-Open No. 2007-230234, which has the step of forming a top portion of the flow path on the flow path wall provided on the substrate, an ink jet recording head in which discharge ports are arranged at a high density can be produced with good accuracy while reducing the production cost.

SUMMARY OF THE INVENTION

According to the present invention, there is provided a process for producing a liquid discharge head comprising a substrate having an energy-generating element for discharging a liquid on a first surface thereof and a liquid supply path passing through from the first surface to a second surface opposing to the first surface, and an discharge port forming member having a discharge port communicating with the supply path through a flow path, the process including:

a first resin layer forming step of providing a first photosensitive resin layer for forming a part of the discharge port forming member in a region covering an opening of the supply path in the first surface of the substrate;

a flow path pattern latent image forming step of forming a latent image of a pattern of the flow path in the first photosensitive resin layer by exposure;

a second resin layer forming step of providing a negative second photosensitive resin layer for forming a part of the discharge port forming member on the first photosensitive resin layer in which the latent image of the flow path pattern is formed;

a curing step of curing a portion, opposing to the opening of the supply path in the first surface of the substrate, of the second photosensitive resin layer;

a discharge port pattern latent image forming step of forming a latent image of a pattern of the discharge port in the second photosensitive resin layer by exposure; and a flow path and discharge port forming step of developing the latent images of the respective patterns of the flow path and the discharge port to form the flow path and the discharge port.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

There are demands for more densifying a discharge port arrangement of an ink jet recording head and compactifying flow path sizes (for example, flow path width and flow path height) in association therewith for the purposes of improving image quality by achieving higher definition of images and of forming an image at high speed. In addition, in the case of two-component image formation in which an image is formed by using an ink and a reaction liquid or treatment liquid which aggregates a coloring material component in the ink, equivalent performance is also required for a liquid discharge head for applying other liquids than the ink, such as a reaction liquid, to a recording medium. Further, equivalent performance is also required for a liquid discharge head used for applying a conductive material upon formation of a high-definition electronic circuit.

In a liquid discharge head of such a structure that a discharge port is formed after a top portion is placed on a flow path wall surrounding a space and being provided on a substrate on which an energy-generating element is provided as disclosed in Japanese Patent Application Laid-Open No. 2007-230234, it is important to more increasing the accuracy of the flow path height for satisfying such required performance as described above. In a long liquid discharge head in which a great number of discharge ports are arranged in an array, for example, it is necessary to inhibit occurrence of bending of a top portion when a plate member forming the top portion is bonded on an upper portion of a flow path wall on the substrate. In addition, in the case where a water-repellent layer is provided on a surface to which a discharge port in the top portion of a flow path is opened, a solvent contained in a material for forming the water-repellent layer may penetrate into the member forming the top portion in some cases to soften such a portion, thereby causing bending or sagging in an inward direction of the flow path. Further, even in the case using a step of laminating a resist layer containing a solvent on a top portion to work the top portion, the occurrence of bending or sagging in an inward direction of the flow path may likewise occur in some cases. It is effective to inhibit the occurrence of such bending or sagging for improving the accuracy of the flow path height.

Thus, it is an object of the present invention to provide a process for producing a liquid discharge head in which bending of a top portion can be inhibited to stabilize a flow path height and to improve the accuracy of the flow path height in a step of providing the top portion on a flow path wall forming member provided on a substrate.

Embodiments of the present invention will now be described with reference to the accompanying drawings.

<Liquid Discharge Head>

Figure 3:
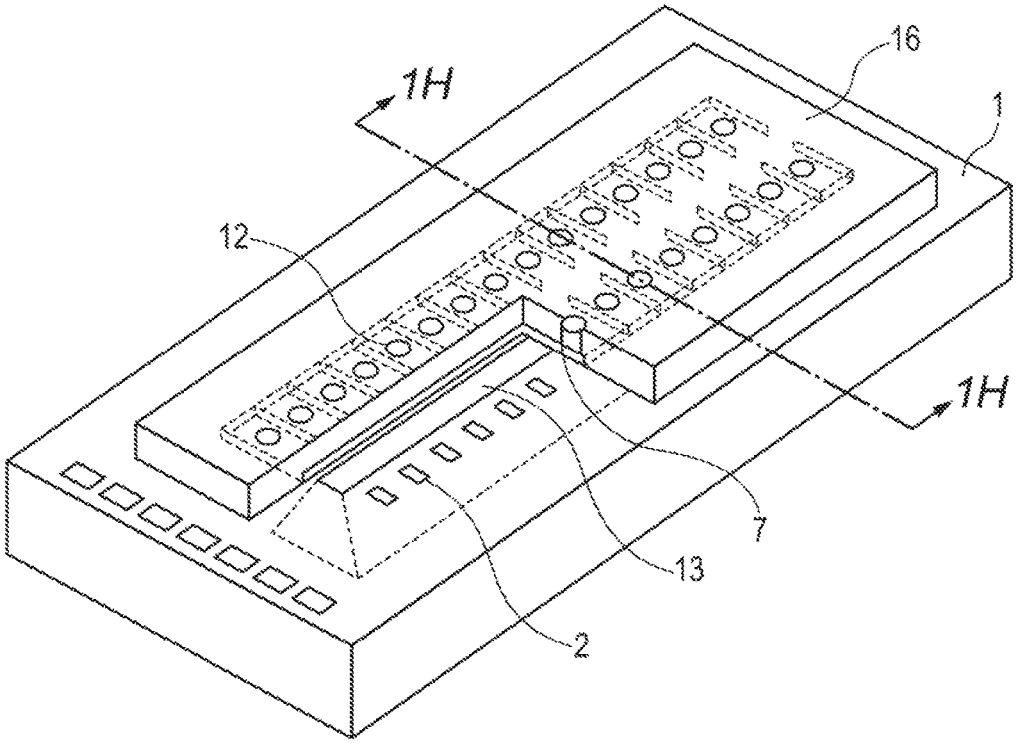
FIG. 3 is a schematic perspective view illustrating an example of a liquid discharge head.

FIG. 3 is a schematic perspective view (partly sectional view) illustrating an exemplary liquid discharge head which can be produced according to a production process of the present invention.

As illustrated in FIG. 3, the liquid discharge head has a substrate 1 which has an energy-generating element 2 which generates energy for discharging a liquid and a liquid supply path 13, and a flow path forming member (discharge port forming member) 16 having a flow path 7 communicating with the supply path 13 and a discharge port 12 communicating with the flow path 7. The substrate 1 has a first surface having the energy-generating element 2 and a second surface opposing to the first surface, and the supply path 13 is formed as a through-hole passing through from the first surface to the second surface in a thickness-wise direction of the substrate 1.

For example, a Si (silicon) wafer having a crystal axis (100) may be used as the substrate 1.

For example, an electrothermal converter or a piezoelectric element may be used as the energy-generating element 2. When the electrothermal converter is used as the energy-generating element 2, a neighbor liquid is heated by the electrothermal converter, thereby causing a state change in the liquid to discharge the liquid. When the piezoelectric element is used as the energy-generating element 2, a pressure is applied to a liquid by deformation of the piezoelectric element to discharge the liquid.

When recording is conducted on a recording medium such as paper by using the liquid discharge head illustrated in FIG. 3, the surface in which the discharge port 12 is formed is arranged so as to face a recording surface of the recording medium. A liquid (for example, an ink) filled into the flow path 7 through the supply path 13 is then discharged from the discharge port 12 by using energy generated by the energy-generating element 2, and that liquid is applied to the recording medium, thereby conducting recording. In this case, the liquid discharge head is used as an ink jet recording head.

Incidentally, the liquid discharge head is not limited to the case where it is used as the ink jet recording head. For example, in the case of two-component image formation in which an image is formed by using an ink and a reaction liquid or treatment liquid which aggregates a coloring material component in the ink, the head may also be used as a liquid discharge head for applying other liquids than the ink, such as the reaction liquid, to a recording medium, or it may be used for printing of an electronic circuit.

<Production Process for Liquid Discharge Head>

FIGS. 1A to 1H are schematic sectional views for illustrating a process for producing a liquid discharge head according to an embodiment of the present invention. Incidentally, FIGS. 1A to 1H illustrate respective steps in sections taken along line 1H-1H in FIG. 3.

Figure 1A:
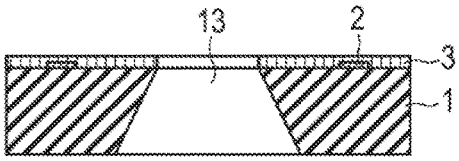
FIGS. 1A, 1B, 1C, 1D, 1E, 1F, 1G and 1H are schematic flow process charts illustrating a process for producing a liquid discharge head according to an embodiment of the present invention and Example 1.

A substrate 1 of a structure illustrated in FIG. 1A is first provided. The substrate 1 has an energy-generating element 2 and one opening of a liquid supply path 13 on a first surface thereof, and the other opening of the supply path 13 on a second surface opposing to the first surface.

As a method for forming the supply path 13, a method of etching a predetermined portion of the second surface of the substrate 1 may be used. Under such a state that a non-etched portion of the second surface of the substrate 1 formed of, for example, a silicon wafer is covered with a resist, wet etching is conducted until a through-hole having a predetermined opening diameter is obtained, whereby the supply path 13 can be formed. As an etchant, for example, TMAH (tetramethylammonium hydroxide) or KOH (potassium hydroxide) may be used. Alternatively, the supply path 13 may also be formed by conducing dry etching such as an RIE (reactive ion etching) method. Further, the supply path 13 may also be formed in the substrate 1 by laser ablation or sand blasting. In addition, a protecting film such as a passivation film 3 may also be formed as a film for protecting the energy-generating element 2 provided on a surface on a side opposing to a surface from which the opening of the supply path starts before the supply path 13 is formed.

A first resin layer forming step of providing a first photosensitive resin layer in a region covering the opening of the supply path 13 in the first surface of the substrate 1 so as to be across this opening is then conducted. This first resin layer forming step can be conducted by laminating a photosensitive resin material (photosensitive resin composition) for forming the first photosensitive resin layer on a predetermined region of the substrate 1. Various coating methods such as a spin coating method and a slit coating method, or a transfer method of transferring a photosensitive resin member preformed so as to be able to maintain the shape of a sheet or a film to a predetermined region of the substrate 1 by a lamination method or a pressing method may be used for the forming of the first photosensitive resin layer.

Among these methods, the transfer method is favorable because the number of steps can be reduced, a treatment for flowing-in of the first photosensitive resin layer into the opening of the supply path 13 is unnecessary, and the thickness of the first photosensitive resin layer, which defines the flow path height, can be easily controlled. An embodiment of this method will now be described.

Figure 1B:
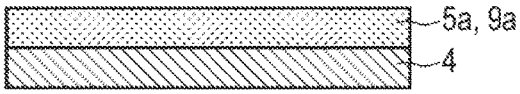

As illustrated in FIG. 1B, a photosensitive resin member 5*a* is formed on a support 4 as a layer capable of maintaining the shape of a sheet or a film. This photosensitive resin member 5*a* is a resin member for a first photosensitive resin layer and will become a first photosensitive resin layer 5 by transferring it from the support 4 to a substrate 1 for the liquid discharge head.

For example, a spin coating method or a slit coating method may be used as a method for forming the photosensitive resin member 5*a* on the support 4.

The photosensitive resin member 5*a* is favorably formed in a thickness of 5 to 30 μm on the substrate 4. Therefore, the viscosity of a coating liquid containing a resin material for forming the photosensitive resin member 5*a* is favorably 5 to 150 cP.

One or more solvents selected from the group consisting of propylene glycol monomethyl ether acetate (PGMEA), cyclohexanone, methyl ethyl ketone and xylene may be used as a solvent used in preparation of the coating liquid for forming the photosensitive resin member 5*a*.

A resin publicly known as a resin for forming the liquid discharge head, such as an epoxy resin, an acrylic resin and a urethane resin which are soluble in an organic solvent, is favorably used as a resin material used for forming the photosensitive resin member 5*a*. These resins may be used either singly or in any combination thereof. As examples of the epoxy resin, there may be mentioned a bisphenol A type epoxy resin, a cresol novolak type epoxy resin and an alicyclic epoxy resin. Examples of the acrylic resin include polymethyl methacrylate, and examples of the urethane resin include polyurethanes. A photo-initiator or a photosensitizer may be mixed into the coating liquid for obtaining desired photosensitivity. The photosensitivity of the first photosensitive resin layer 5 can be arbitrarily set as long as the flow path wall with intended performance and size accuracy can be formed, and the resin layer favorably has negative photosensitivity from the viewpoints of workability and mechanical strength of the flow path wall.

As examples of the support 4, there may be mentioned a film, a glass plate and a silicon wafer, and the film is favorable taking separation from the photosensitive resin member 5*a* later into consideration. Examples of the film include resin films such as a polyethylene terephthalate (PET) film, a polyimide film and a polyamide (polyaramid) film. The photosensitive resin member 5*a* can be obtained by applying a coating liquid to a surface of the support 4 and drying it. In addition, a coating surface of the support 4, to which the coating liquid is applied, may be subjected to a releasing treatment for making the photosensitive resin member 5*a* easily releasable.

Figure 1C:
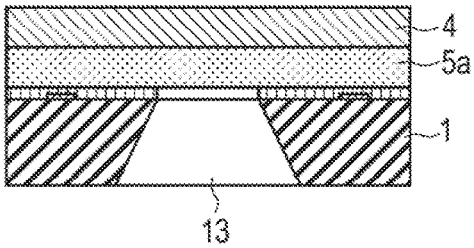

The photosensitive resin member 5*a* is then transferred and joined to the substrate 1 from the support 4 through a state of FIG. 1C to conduct a first resin layer forming step of providing a first photosensitive resin layer 5, thereby obtaining a structure in which the first photosensitive resin layer 5 is provided on the substrate. In this step, the first photosensitive resin layer 5 is formed across the opening of the supply path 13 on the substrate 1. This step will now be described.

The photosensitive resin member 5*a* is reversed from the state illustrated in FIG. 1B so as to be directed to a direction of the substrate 1 as illustrated in FIG. 1C and joined to the first surface of the substrate 1 having the energy-generating element 2 so as to be across the opening of the supply path 13, thereby obtaining the first photosensitive resin layer 5.

The first photosensitive resin layer 5 that is bonded to the substrate 1 is favorably formed so as to have a thickness of 5 to 25 μm for the purpose of equalizing the thickness of the first photosensitive resin layer 5 on the substrate 1 to the height of the flow path 7. The thickness of the first photosensitive resin layer 5 is an important factor for supplying an ink to the energy-generating element 2 from the supply path 13. Therefore, a method capable of forming the first photosensitive resin layer 5 with good thickness accuracy is favorable as a method for joining the photosensitive resin member 5*a* to the substrate 1. A lamination method may be used as a method for transferring the photosensitive resin member 5*a* to the substrate 1. An adhesive may also be used in the joining between these components as needed. Transferring with a roller system or transferring under vacuum is favorably conducted taking bubble dischargeability upon the transfer into consideration.

In the case where no adhesive is used, the photosensitive resin member 5*a* is adjusted so as to have such meltability and softenability as to be able to join it to the substrate 1 with intended mechanical strength under heating and/or pressurizing conditions upon the transfer to the substrate 1.

Since the photosensitive resin layer 5 forms a flow path wall of the flow path 7 formed across the opening of the supply path 13, a material capable of providing a flow path wall having high mechanical strength and ink resistance is selected as the photosensitive resin member 5*a* which will become the first photosensitive resin layer 5.

Figure 1D:
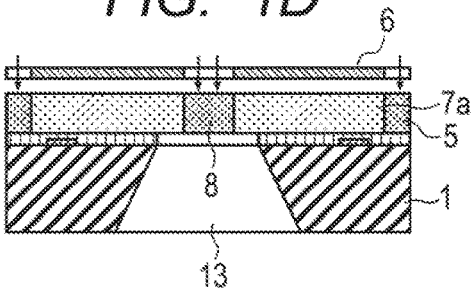

As illustrated in FIG. 1D, a flow path pattern latent image forming step of forming a latent image pattern 7*a* which will become the flow path 7 in the first photosensitive resin layer 5 by exposure is then conducted. This step will now be described.

As illustrated in FIG. 1D, the first photosensitive resin layer 5 is irradiated with (or exposed to) light through a mask 6, and a baking treatment (post exposure bake (PEB)) is conducted after the exposure, thereby forming the latent image pattern 7*a* to be the flow path 7.

The latent image pattern 7*a* is favorably formed by photolithography for achieving good accuracy of the positional relation between the discharge port 12 and the energy-generating element 2. Incidentally, development of the latent image pattern 7*a* is not performed at this time. Other portions than the latent image pattern 7*a* of the first photosensitive resin layer 5 are portions which will become a side wall 8 of the flow path 7.

Figure 1E:
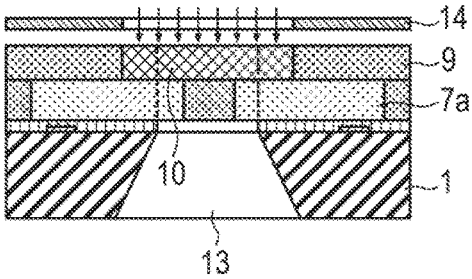

As illustrate in FIG. 1E, a second resin layer forming step of forming a second photosensitive resin layer on the first photosensitive resin layer 5 is then conducted. This step will now be described.

As illustrated in FIG. 1E, the second photosensitive resin layer 9 is formed on the first photosensitive resin layer 5 in which the latent image pattern 7*a* is formed. A negative photosensitive resin layer is used as the second photosensitive resin layer 9.

For example, various coating methods such as a spin coating method and a slit coating method or a transfer method of transferring a photosensitive resin member preformed so as to be able to maintain the shape of a sheet or a film to a predetermined region of the photosensitive resin layer 5 by a lamination method or a pressing method may be used as a method for laminating the second photosensitive resin layer 9 on the first photosensitive resin layer 5.

Among these methods, the transfer method of transferring to the first photosensitive resin layer a photosensitive resin material for the second photosensitive resin layer formed on a support is favorable because the number of steps can be reduced, and the thickness of the second photosensitive resin layer, which defines the length of the discharge port 12, can be easily controlled. The material for forming the first photosensitive resin layer 5 may be used as a material for forming the second photosensitive resin layer 9. However, the photosensitivity of the second photosensitive resin layer 9 is adjusted to a negative type. Incidentally, the resin materials used for forming the first photosensitive resin layer 5 and the second photosensitive resin layer 9 may be the same or different.

A sensitivity difference with respect to light is favorably set between the second photosensitive resin layer 9 and the first photosensitive resin layer 5 so as not to affect the latent image pattern 7*a* formed in the first photosensitive resin layer 5 upon exposure of the second photosensitive resin layer 9. In this embodiment, the photosensitivity of the first photosensitive resin layer 5 is set lower than the photosensitivity of the second photosensitive resin layer 9.

Thereafter, a curing step of curing a curing treatment object, which is a portion 10 containing an opposing portion opposing to the opening of the supply path 13 in the first surface of the substrate 1 of the second photosensitive resin layer 9 by exposure through a mask 14 and conducting PEB as needed is conducted. The rigidity of the portion 10 can be enhanced by this curing step.

It is enough that the portion 10 is an opposing portion opposing to the supply path 13 of the second photosensitive resin layer 9. This opposing portion means a region where the opposing portion conforms to the outline of the opening of the supply path 13 when the outline of the opposing portion is projected in a direction of the first surface of the substrate 1 by parallel light. In addition, the portion 10 is favorably a region containing this opposing portion and a portion neighboring thereon and sufficiently including the outline of the opening of the supply path 13 when the outline of the portion 10 is projected in a direction of the substrate by parallel light. In other words, the portion 10 is favorably larger than the opening of the supply path 13. Since the discharge port 12 is formed in the second photosensitive resin layer 9, inclusive of the water-repellent layer 11, in a subsequent step, a portion which will become the discharge port 12 and a portion neighboring thereon are favorably not exposed. Further, the portion 10 as the curing object and the portion where the discharge port 12 will be formed as an uncuring portion are favorably partitioned off as separate regions.

Figure 1F:
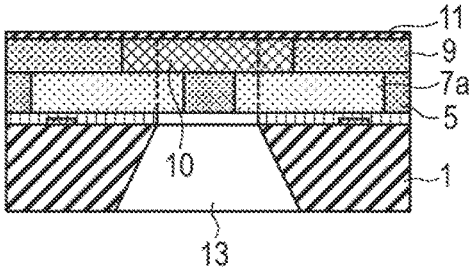

As illustrated in FIG. 1F, the water-repellent layer 11 is then formed on the second photosensitive resin layer 9 the portion 10 of which has been cured. The water-repellent layer 11 is formed with a material containing a solvent for forming the water-repellent layer 11. In addition, the water-repellent layer 11 is not limited to that having photosensitivity. However, a water-repellent layer 11 having the same photosensitivity as the second photosensitive resin layer is used in this embodiment in that a region covered with the water-repellent layer 11 in the surroundings of the discharge port 12 is formed with good accuracy. As a method for forming the water-repellent layer 11, a method of applying a water-repellent layer forming material containing a solvent (liquid composition) to the second photosensitive resin layer 9 by, for example, a spin coating method or a slit coating method and drying it is used Since exposure is conducted for the portion 10 of the second photosensitive resin layer 9, and PEB is then conducted as needed to cure the portion 10, whereby the rigidity and solvent resistance thereof are enhanced before the water-repellent layer 11 is formed, the portion 10 is not affected by the solvent contained in the water-repellent layer forming material containing the solvent, and so the occurrence of bending or sagging into the opening of the supply path 13 of the first and second photosensitive resin layers 5 and 9 can be effectively inhibited.

Incidentally, when the portion 10 of the curing object of the second photosensitive resin layer 9 is not exposed, the solvent contained in the water-repellent layer 11 penetrates into the interiors of the first and second photosensitive resin layers 5 and 9, and so softening or dissolution occurs in portions of the first and second photosensitive resin layers 5 and 9 into which the solvent has penetrated, thereby causing the bending or sagging into the opening of the supply path 13. The reason for this is that the interior of the opening of the supply path 13 becomes hollow, and so propping the first surface of the substrate 1 is lacked.

Even when other regions than the portion 10 are in an uncured state on the other hand, the regions are supported by or propped with the first surface of the substrate 1, so that the bending or sagging does not occur in these portions of the second photosensitive resin layer. The layer containing the solvent is not limited to the water-repellent layer 11 and can be suitably changed. The layer containing the solvent may be, for example, a solvent-containing resist.

Figure 1G:
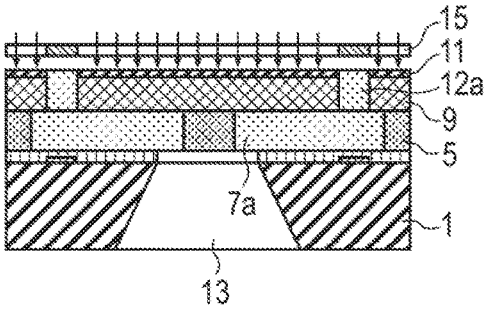

As illustrated in FIG. 1G, a discharge port pattern latent image forming step of forming a latent image pattern 12*a* of the discharge port in the second photosensitive resin layer 9 and the water-repellent layer 11 is then conducted. This step will now be described.

As illustrated in FIG. 1G, the second photosensitive resin layer 9 and the water-repellent layer 11 are irradiated with (or exposed to) light through a mask 15 to form the latent image pattern 12*a* which will become a discharge port 12.

In this embodiment, the second photosensitive resin layer 9 and the water-repellent layer 11 are subjected to an exposure treatment in the discharge port pattern latent image forming step to form the latent pattern 12*a*.

Figure 1H:
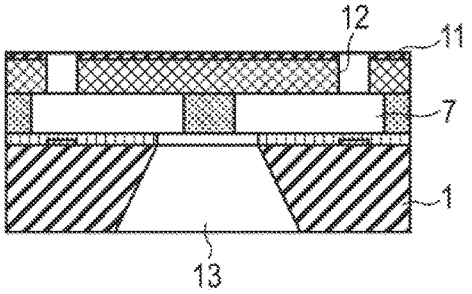

As illustrated in FIG. 1H, a flow path and discharge port forming step of respectively removing the latent images 7*a* and 12*a* of the flow path and the discharge port from the first and second photosensitive resin layers 5, 9 and from the water-repellent layer 11 by a development treatment to form the flow path 7 and the discharge port 12 is then conducted. This step will now be described.

As illustrated in FIG. 1H, the first and second photosensitive resin layers 5 and 9 and the water-repellent layer 11 are impregnated with a developing liquid to develop the latent images 7*a* and 12*a* for the flow path and the discharge port, thereby removing the latent images 7*a* and 12*a* for the flow path and the discharge port to form the discharge port 12 and the flow path 7.

One or more solvents selected from the group consisting of propylene glycol monomethyl ether acetate (PGMEA), tetrahydrofuran, cyclohexanone, methyl ethyl ketone and xylene are favorably used as a developing solvent.

Mounting of an ink supply member for supplying a liquid and electrical junction of an electric wiring member for driving the energy-generating element 2 are conducted on the liquid discharge head formed in this manner (not illustrated).

According to this embodiment, after the portion 10 containing at least the opposing portion opposing to the opening of the supply port 13 of the second photosensitive resin layer 9 is cured, the water-repellent layer 11 is then formed on the second photosensitive resin layer 9 by using the solvent-containing material. At least the opposing portion is cured, whereby the solvent resistance of the opposing portion is improved, and so deformation such as the above-described bending or sagging is hard to occur. Accordingly, the top portion of the flow path 7 formed by this opposing portion can be inhibited from sagging on the side of the supply path 13, and so the height of the flow path 7 can be controlled with good accuracy.

In this embodiment, an exposure treatment performed from a side which will become a first surface having the discharge port 12 of the liquid discharge head can be utilized when at least the opposing portion opposing to the opening of the supply path 13 of the second photosensitive resin layer 9 is exposed and cured, and so the portion 10 to be cured can be set with high accuracy.

In addition, in this embodiment, the first photosensitive resin layer 5 is formed across the opening of the supply path 13 in the first surface of the substrate 1, so that the first photosensitive resin layer 5 can be inhibited from entering into the supply path 13.

Further, when the portion 10 of the curing object containing the opposing portion opposing to the supply path and the portion neighboring thereon of the second photosensitive resin layer 9 is cured in this embodiment, both ends of the portion 10 after the curing can be supported by the substrate 1 through the first photosensitive resin layer 5 to more stabilize the position of the portion 10. Thus, this is favorable.

Incidentally, this embodiment includes the step of forming the water-repellent layer 11 with the water-repellent layer forming material containing the solvent before formation of the discharge port 12. However, a step of forming the water-repellent layer 11 using a solvent-free system may also be used. In addition, the water-repellent layer 11 may be provided as needed. In the process for producing the liquid discharge head according to the present invention, the portion 10 of the second photosensitive resin layer 9 is cured, whereby the occurrence of bending of the second photosensitive resin layer 9 which will become the top portion of the flow path can be inhibited, and so such an effect as to control the flow path height with good accuracy can be achieved when the water-repellent layer 11 is not provided or when the water-repellent layer 11 is formed by a solvent-free system.

EXAMPLES

Example 1

Example 1 of the present invention will now be described with reference to the schematic flow process charts illustrated in FIGS. 1A to 1H.

As illustrated in FIG. 1A, a supply path 13 was first formed in a silicon substrate 1 including an energy-generating element 2 by wet etching. In the wet etching, an aqueous solution obtained by diluting TMAH to 22% by mass and controlling the temperature thereof to 83° C. was used as an etchant, and the substrate 1 on which an etching mask (not illustrated) had been provided was immersed for 20 hours in this etchant to form the supply path 13.

As illustrated in FIG. 1B, a photosensitive resin member 5*a* used for forming a first photosensitive resin layer 5 was then formed on a PET film to be a support 4. Specifically, a solution prepared by dissolving in a solvent (PGMEA) an epoxy resin (N-695, product of DIC Corporation) and a photoinitiator (CPI-210S, product of SAN-APRO LIMITED) having sensitivity at an exposure wavelength of 365 nm upon formation of a latent image of a flow path pattern in Step 4 was applied to the support 4 by slit coating and dried at 100° C. in an oven to form a photosensitive resin member 5*a* in the form of a film. The content of the epoxy resin was controlled to an amount necessary for forming a first photosensitive resin layer 5 having intended physical properties and layer thickness. The amount of the photoinitiator added was controlled in such a manner that the photosensitivity of the first photosensitive resin layer 5 becomes lower than that of a second photosensitive resin layer 9. In this Example, the photosensitivities of these layers were set in such a manner that the photosensitivity of the second photosensitive resin layer 9 became at least 3 when the photosensitivity of the first photosensitive resin layer 5 was regarded as 1. The photosensitivities are set in this manner, whereby a latent image of a flow path pattern formed in the first photosensitive resin layer 5 is not affected upon formation of a latent image of a discharge port pattern, and so the latent image of the discharge port pattern can be selectively formed in the second photosensitive resin layer 9. Incidentally, the thickness of the photosensitive resin member 5*a* was controlled to 16 μm (Step 2).

As illustrated in FIG. 1C, the photosensitive resin member 5*a* was then joined to the substrate 1 in which the supply path 13 had been preformed by a roll type laminator (VTM-200, manufactured by Takatori Corporation) under conditions of 90° C. in temperature and 0.4 Mpa in pressure in such a manner that the thickness of the photosensitive resin member 5*a* on the substrate 1 became 15 μm. Thereafter, the support 4 was separated at ordinary temperature (Step 3).

As illustrated in FIG. 1D, pattern exposure was then conducted with an exposure amount of 5,000 J/m$^2$ with light having an exposure wavelength of 365 nm through a mask 6 by an exposure apparatus (FPA-3000i5+, manufactured by Canon Inc.), and PEB was conducted for 5 minutes at 50° C., thereby forming a latent image of a flow path pattern in such a manner that a non-exposed portion of the first photosensitive resin layer 5 became an ink flow path 7 (Step 4).

As illustrated in FIG. 1E, a photosensitive resin member 9*a* for forming a second photosensitive resin layer 9 was then formed in the form of a film on a PET film to be a support 4 as in Step 2. Specifically, a solution prepared by dissolving in a solvent (PGMEA) an epoxy resin (157S70, product of Japan Epoxy Resin Co., Ltd.) and a photoinitiator (LW-S1, product of SAN-APRO LIMITED) having sensitivity at an exposure wavelength of 365 nm upon formation of an ink discharge port pattern in Step 6 was applied to the support 4 by a slit coating method and dried, thereby forming the photosensitive resin member 9*a*. The content of the epoxy resin was controlled to an amount necessary for forming a second photosensitive resin layer 9 having intended physical properties and layer thickness. The amount of the photoinitiator added was set in such a manner that the photosensitivity of the second photosensitive resin layer 9 became 3 or more when the photosensitivity of the first photosensitive resin layer 5 was regarded as 1 as described above.

The filmy photosensitive resin member 9*a* for forming the second photosensitive resin layer 9, which had been provided on the PET film to be the support 4, was joined to the first photosensitive resin layer 5 in which the latent image of the flow path pattern prepared in Step 4 had been formed under conditions of 90° C. in temperature and 0.4 Mpa in pressure in such a manner that the thickness thereof became 15 μm (Step 5). Thereafter, the support 4 was separated at ordinary temperature to obtain the second photosensitive resin layer.

Further, pattern exposure was conducted with an exposure amount of 1,000 J/m$^2$ with light having an exposure wavelength of 365 nm by an exposure apparatus through a mask 14, and PEB was conducted for 4 minutes at 90° C., thereby curing an upper neighborhood of the opening of the supply path 13 in the second photosensitive resin layer 9. At that time, a region having a size larger than the width of the opening of the supply path 13 was exposed. However, since the discharge port is formed, inclusive of the water-repellent layer 11, in a subsequent step, only a 50 μm outer region outside a portion opposing to the opening of the supply port 13 was exposed in this Example.

As illustrated in FIG. 1F, a coating liquid containing a water-repellent material and a solvent was applied by a slit coating method and baked for 5 minutes at 50° C. Incidentally, in this Example, a condensation product of a hydrolyzable silane compound having a fluorine-containing group or a hydrolyzable silane compound having a cationically polymerizable group was used as the water-repellent material. PGMEA was used as the solvent for the water-repellent material. The concentration of the condensation product of the hydrolyzable silane compound as a water-repellent component in the water-repellent material was controlled to an amount necessary for obtaining an intended water-repellent layer. Since the upper neighborhood of the opening of the supply path 13 in the second photosensitive resin layer 9 was cured in advance at that time, so that the sagging into the opening of the supply path 13 of the first and second photosensitive resin layers 5 and 9 did not occur. Incidentally, when the neighborhood was not cured in advance, the first and second photosensitive resin layers 5 and 9 over the opening of the supply path 13 caused sagging of the extent of about 3 μm.

As illustrated in FIG. 1G, pattern exposure was then conducted in an exposure amount of 1,000 J/m$^2$ with light having an exposure wavelength of 365 nm by an exposure apparatus (FPA-3000i5+, manufactured by Canon Inc.) through a mask 15, and PEB was conducted for 4 minutes at 90° C., thereby forming a latent image of a discharge port pattern in such a manner that a non-exposed portion of the second photosensitive resin layer 9 became an ink discharge port 12 (Step 6).

Lastly, the respective layers are impregnated with a developing liquid (PGMEA), whereby the non-exposed portion of the second photosensitive resin layer 9 was also removed at the same time of removal of the first photosensitive resin layer 5 as illustrated in FIG. 1H to form the discharge port 12 and the flow path 7 (Step 7).

By the above-described process, a liquid discharge head illustrated in FIG. 3 composed of a flow path forming member 16 and the substrate 1 was obtained.

Example 2

Example 2 of the present invention will then be described with reference to the schematic flow process charts illustrated in FIGS. 2A to 2H. Incidentally, in FIGS. 2A to 2H, the same reference signs are given to components having the same functions as those illustrated in FIGS. 1A to 1H.

Figure 2A:
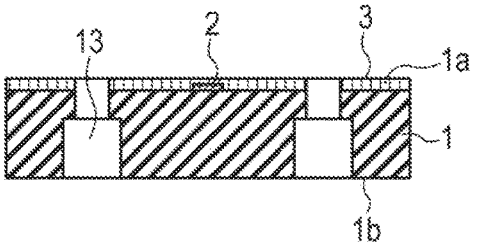
FIGS. 2A, 2B, 2C, 2D, 2E, 2F, 2G and 2H are schematic flow process charts illustrating a process for producing a liquid discharge head according to Example 2 of the present invention.

As illustrated in FIG. 2A, dry etching was first conducted from front and back surfaces of an Si-made substrate 1 including an energy-generating element 2, thereby forming a plurality of liquid supply paths 13 independent of each other in the substrate 1 (Step 1).

Figure 2B:
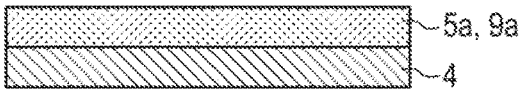

As illustrated in FIG. 2B, a photosensitive resin member 5*a* for forming a first photosensitive resin layer 5 was formed on a PET film to be a support 4 in the same manner as in Example 1. Incidentally, the thickness of the photosensitive resin member 5*a* was controlled to 16 μm (Step 2).

Figure 2C:
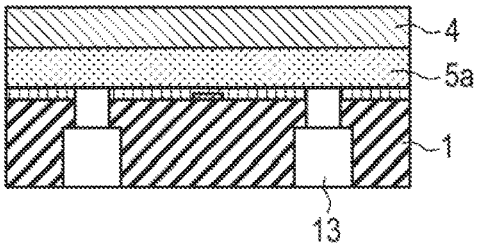

As illustrated in FIG. 2C, the photosensitive resin member 5*a* was then joined to the substrate 1 in which the supply paths 13 had been preformed by a roll type laminator (VTM-200, manufactured by Takatori Corporation) under conditions of 90° C. in temperature and 0.4 Mpa in pressure in such a manner that the thickness of the photosensitive resin member 5*a* on the substrate 1 became 15 μm. Thereafter, the support 4 was separated at ordinary temperature (Step 3).

Figure 2D:
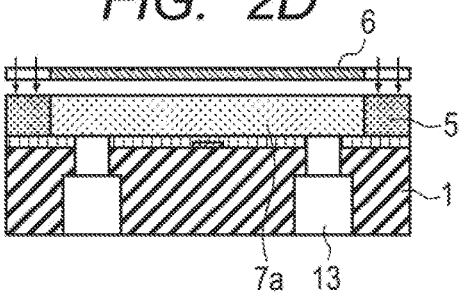
Figure 2E:
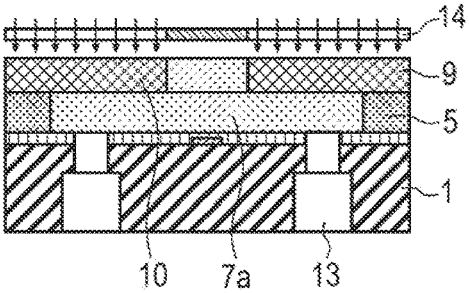

As illustrated in FIG. 2D, pattern exposure was then conducted with an exposure amount of 5,000 J/m$^2$ with light having an exposure wavelength of 365 nm through a mask 6 by an exposure apparatus (FPA-3000i5+, manufactured by Canon Inc.), and PEB was conducted for 5 minutes at 50° C., thereby forming a latent image of a flow path pattern in such a manner that a non-exposed portion of the first photosensitive resin layer 5 became a flow path 7 (Step 4).

A photosensitive resin member 9*a* for forming a second photosensitive resin layer 9 was then formed in the form of a film on a PET film to be a support 4 in the same manner as in Example 1, and joined to the first photosensitive resin layer 5 in which the latent image of the flow path pattern prepared in Step 4 had been formed under conditions of 90° C. in temperature and 0.4 Mpa in pressure in such a manner that the thickness thereof became 15 μm (Step 5). Thereafter, the support 4 was separated at ordinary temperature.

Even in this Example, the amounts of the photoinitiator added to the first and second photosensitive resin layers 5 and 9 were set in such a manner that the photosensitivity of the second photosensitive resin layer 9 became 3 or more when the photosensitivity of the first photosensitive resin layer 5 was regarded as 1.

Figure 2F:
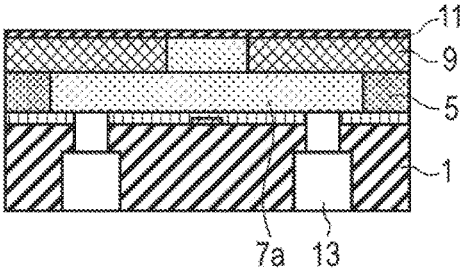

Further, pattern exposure was conducted with an exposure amount of 1,000 J/m$^2$ with light having an exposure wavelength of 365 nm by an exposure apparatus through a mask 14, and PEB was conducted for 4 minutes at 90° C., thereby curing an upper neighborhood of the opening of the supply path 13 in the second photosensitive resin layer 9. At that time, an area having a size larger than the width of the opening of the supply path 13 was exposed. However, since the discharge port is formed, inclusive of the water-repellent layer 11, in a subsequent step, only a 50 μm outer region outside a region opposing the opening of the supply port 13 was exposed in this Example. As illustrated in FIG. 2F, a water-repellent layer 11 was then formed by a slit coating method in the same manner as in Example 1. Since the upper neighborhood of the opening of the supply path 13 in the second photosensitive resin layer 9 was cured in advance at that time, so that the sagging into the opening of the supply path 13 of the first and second photosensitive resin layers 5 and 9 did not occur. Incidentally, when the neighborhood was not cured in advance, the first or second photosensitive resin layer 5 or 9 over the opening of the supply path 13 caused sagging of the extent of about 3 μm.

Figure 2G:
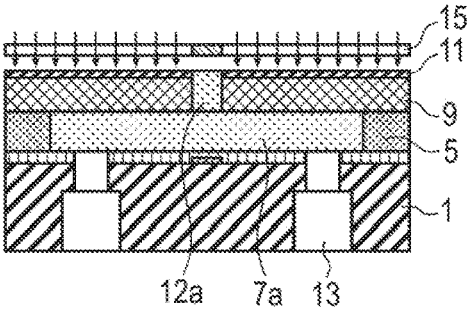

As illustrated in FIG. 2G, pattern exposure was then conducted with an exposure amount of 1,000 J/m$^2$ with light having an exposure wavelength of 365 nm by an exposure apparatus (FPA-3000i5+, manufactured by Canon Inc.) through a mask 15, and PEB was conducted for 4 minutes at 90° C., thereby forming a latent image of a discharge port pattern in such a manner that a non-exposed portion of the second photosensitive resin layer 9 became a discharge port 12 (Step 6).

Figure 2H:
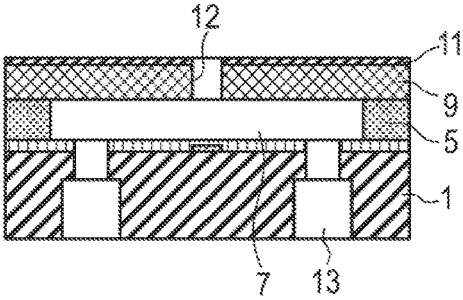

Lastly, the respective layers are impregnated with a developing liquid (PGMEA), whereby the non-exposed portion of the second photosensitive resin layer 9 was also removed at the same time of removal of the first photosensitive resin layer 5 as illustrated in FIG. 2H to form the discharge port 12 and the flow path 7 (Step 7).

By the above-described process, a liquid discharge head illustrated in FIG. 3 composed of a flow path forming member 16 and the substrate 1 was obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-057952, filed Mar. 20, 2015, which is hereby incorporated by reference herein in its entirety.

What is claimed is:

1. A process for producing a liquid discharge head comprising a substrate having an energy-generating element for discharging a liquid on a first surface thereof and a liquid supply path passing through from the first surface to a second surface opposing to the first surface, and a discharge port forming member having a discharge port communicating with the supply path through a flow path, the process comprising:

a first resin layer forming step of providing a first photosensitive resin layer for forming a part of the discharge port forming member in a region covering an opening of the supply path in the first surface of the substrate;

a flow path pattern latent image forming step of forming a latent image of a pattern of the flow path in the first photosensitive resin layer by exposure;

a second resin layer forming step of providing a negative second photosensitive resin layer for forming a part of the discharge port forming member on the first photosensitive resin layer in which the latent image of the flow path pattern is formed;

a curing step of curing a portion, opposing to the opening of the supply path in the first surface of the substrate, of the second photosensitive resin layer;

after the curing step, a step of providing a water-repellent layer on the second photosensitive resin layer by using a material containing a solvent, which softens or dissolves an uncured portion of the second photosensitive resin layer;

after the step of providing the water-repellent layer, a discharge port pattern latent image forming step of forming a latent image of a pattern of the discharge port in the second photosensitive resin layer by exposure; and a flow path and discharge port forming step of developing the latent images of the respective patterns of the flow path and the discharge port to form the flow path and the discharge port.

2. The process according to claim 1, wherein the first photosensitive resin layer forming step is conducted by joining a photosensitive resin member formed for the first photosensitive resin layer to the substrate.

3. The process according to claim 2, wherein the joining of the photosensitive resin member to the substrate is conducted by transferring the photosensitive resin member provided on a support to the substrate.

4. The process according to claim 1, wherein the second photosensitive resin layer forming step is conducted by joining a photosensitive resin member formed for the second photosensitive resin layer to the first photosensitive resin layer.

5. The process according to claim 4, wherein the joining of the photosensitive resin member to the first photosensitive resin layer is conducted by transferring the photosensitive resin member provided on a support to the first photosensitive resin layer.

6. The process according to claim 1, wherein the first photosensitive resin layer is of a negative type.

7. The process according to claim 1, wherein the first photosensitive resin layer contains at least one of an epoxy resin, an acrylic resin and a urethane resin.

8. The process according to claim 1, wherein the second photosensitive resin layer contains at least one of an epoxy resin, an acrylic resin and a urethane resin.

9. The process according to claim 1, wherein photosensitivity of the first photosensitive resin layer is lower than that of the second photosensitive resin layer.

10. The process according to claim 1, wherein in the curing step, the portion in the second photosensitive resin layer opposing to the opening of the supply path in the first surface of the substrate is cured by exposure of the second photosensitive resin layer.

11. The process according to claim 10, wherein an area of the portion of the second photosensitive layer exposed in the curing step is smaller than an area of a portion of the second photosensitive layer exposed in the discharge port pattern latent image forming step.

* * * * *